United States Patent [19]

Mielke

[11] 4,180,378

[45] Dec. 25, 1979

[54] APPARATUS FOR THE DEPOSITION OF DRY FIBERS ON A FORAMINOUS FORMING SURFACE

[75] Inventor: Dennis L. Mielke, Neenah, Wis.

[73] Assignee: American Can Company, Greenwich, Conn.

[21] Appl. No.: 915,866

[22] Filed: Jun. 15, 1978

[51] Int. Cl.[2] ..... B29B 1/00

[52] U.S. Cl. ..... 425/83.1

[58] Field of Search ..... 425/83.1

[56] References Cited

U.S. PATENT DOCUMENTS

| | | | |
|---|---|---|---|
| 3,598,680 | 8/1971 | Lee | 425/82.1 |
| 4,014,635 | 3/1977 | Kroyer | 425/83 |

*Primary Examiner*—Robert F. White

*Assistant Examiner*—James R. Hall, Jr.

*Attorney, Agent, or Firm*—Robert P. Auber; Ira S. Dorman; George P. Ziehmer

[57] ABSTRACT

Apparatus for the deposition of dry fibers on a gas permeable wire comprising a plurality of fiber distributors in separate housings, a tunnel connecting the discharge ends of said distributors, said tunnel having the top wall thereof perforated between said distributors, a gas permeable wire extending along said tunnel and including a pair of rollers positioned at opposite ends of said tunnel, means for driving said permeable wire along said tunnel, and means for producing a partial vacuum below said permeable wire and in said tunnel to distribute the fibers uniformly and to prevent their bunching between distributors.

3 Claims, 2 Drawing Figures

APPARATUS FOR THE DEPOSITION OF DRY FIBERS ON A FORAMINOUS FORMING SURFACE

BACKGROUND OF THE INVENTION

This invention is an improvement upon the apparatus described and clamed in U.S. Pat. No. 4,014,635 which issued Mar. 29, 1977 to Karl Kristian Kobs Kroyer.

In additon to the Kroyer patent, the following patents are believed to be pertinent.

U.S. Pat. No. 2,165,280 issued July 11, 1939 to G. M. Lannan for a "Method and Apparatus for Forming a Fibrous Mat". The apparatus is particularly adapted for the production of fiberglass filters for use in air conditioners, and the like. The glass fibers are deposited upon a reticulated belt which passes through the bottom of the machine. U.S. Pat. No. 3,071,822 issued Jan. 8, 1963 to J. G. Meiler for a "Method and Apparatus for Forming a Mat". The patent teaches the use of two or more air laying units in side-by-side configuration for depositing fine and coarse fibers onto the belt to form a mat. The belt is a foraminous belt which has suction chambers immediately below the belt to hold the fibers on the belt.

U.S. Pat. No. 3,080,617 issued Mar. 12, 1963 to K. G. Lytton for a "Fiber Proportioning, Blending, and Preparation Method, System and Apparatus". The disclosed apparatus is directed toward the mixing of different textile fibers into a homogeneous mass. Different yarn is deposited from dispensers onto a common belt.

U.S. Pat. No. 3,598,680 issued Aug. 10, 1971 to C. A. Lee for a "Tandem Air Former". The apparatus is directed to air laying fibrous material at a first station and then air laying additional fibrous material at a second station downstream from the first station to overlap at least partially the fibrous material deposited at the first station. A pressure differential is maintained across the web to hold the web onto the carrier belt or wire.

U.S. Pat. No. 3,645,457 issued Feb. 29, 1972 to G. Berndt, et al for an "Apparatus for Depositing Comminuted Materials Upon Traveling Conveying Means". The Apparatus is essentially a blower for blowing wood chips onto a belt for building up a structure of coarse chips in the center and fine chips on the outer layers, the resulting composite structure being sutiable for the production of fiberboards.

U.S. Pat. No. 3,581,706 pertains to a Kroyer-like apparatus for distributing fibers onto a foraminous wire belt.

U.S. Pat. No. 3,825,381 issued July 23, 1974 to C. E. Dunning, et al for "Apparatus for Forming Airlaid Webs". The apparatus is directed to air laying wood fiber webs onto a high speed foraminous wire or carrier, then wetting it before it is transferred for further processing.

U.S. Pat. No. 3,886,629 issued June 3, 1975 to S. Nakai, et al for an "Apparatus for Producing Fibrous Mats". The apparatus is directed toward grinding or disintegrating pulp to produce pulp fibers which are then deposited onto a moving wire.

Austrian Pat. No. 220,466 issued Aug. 15, 1961 to the Weyerhaeuser Timber Company pertains to the consecutive depositing of wood chips onto a foraminous wire belt having a suction chamber underneath. The belt travels from depositing head to depositing head in a common tunnel.

The Kroyer apparatus of U.S. Pat. No. 4,014,635 uses a fiber distributor which has a housing, a plane-surface perforated bottom wall, and impellers which are mounted for rotation about vertical axes. The impellers are mounted just above the plane-surface bottom wall. Means are also provided in the housing for receiving fibers and additional means are provided for removing fibers of excess size.

Further to the Kroyer patent, a foraminous wire belt moves below the bottom wall of the housing, and a suction box is located below the wire belt. At the front and back walls of the housing, at the points of entrance and exiting of the wire belt, two rollers are positioned to act as sealing members to avoid the intake of substantial amounts of false air. The rollers are mounted so that small gaps are formed between the lower edges of the housing and the roller surfaces. The rollers may be positively driven or may rotate on the wire belt. Typically paper pulp is introduced into the fiber distributor housing after having been disintegrated in, for example, a hammer mill. The rotating impellers drive the fine particles through the perforated bottom wall onto the moving wire belt.

When two Kroyer fiber distributors deliver fibers sequentially to the same wire belt, the fibers typically spring up and fluff on the belt in the region between the Kroyer distributors.

This invention is related to a patent application, filed concurrently herewith by Frederic N. Miller entitled MULTIPLE DISTRIBUTOR HEADS FOR LAYING DRIED FIBERS, Ser. No. 915,865, which pertains to two side-by-side Kroyer type machines, without space therebetween and delivering fibers into a common tunnel onto a foraminous belt.

BRIEF DESCRIPTION OF THE INVENTION

To avoid the springing up or fluffing of a fiber web formed on a wire belt, the exit roller of the upstream Kroyer fiber distributor and the entrance roller of the downstream Kroyer fiber distributor are eliminated and the wire belt is placed in a tunnel from the entrance roller of the upstream Kroyer machine to the exiting roller of the downstream Kroyer machine. Suction chambers are placed beneath the wire belt along the entire length of the tunnel and, in accordance with this invention, the top of the tunnel between the machines is perforated to allow air to flow downward onto the moving belt to prevent the fiber web from fluffing.

It is therefore an object of this invention to prevent fluffs of the fiber web on the wire belt between the fiber laying machines.

BRIEF DESCRIPTION OF THE DRAWINGS

Other objects will become apparent from the folllowing description, taken in connection with the accompanying drawings, in which.

DETAILED DESCRIPTION OF THE INVENTION

Figure 1:
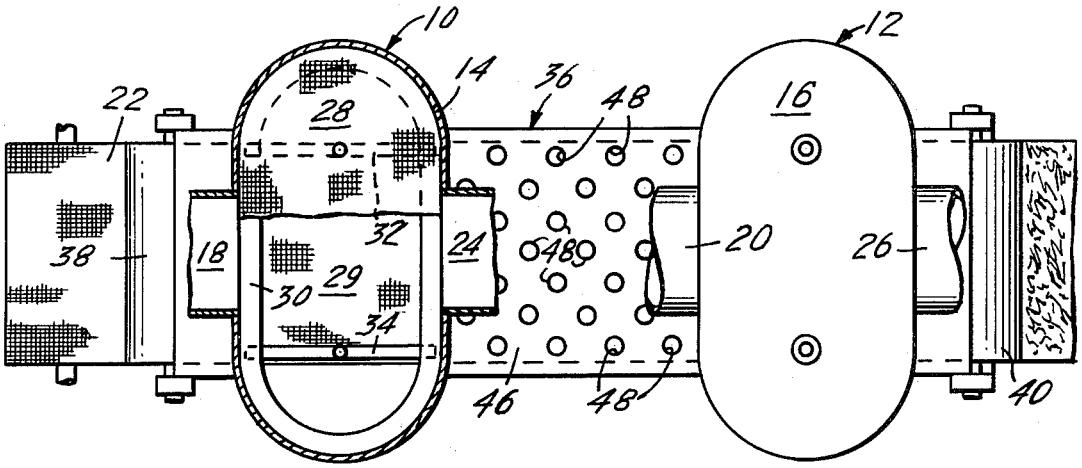
FIG. 1 is a top view, partly in section, of two fiber laying machines, a moving wire belt, and a tunnel surrounding the wire belt.
Figure 2:
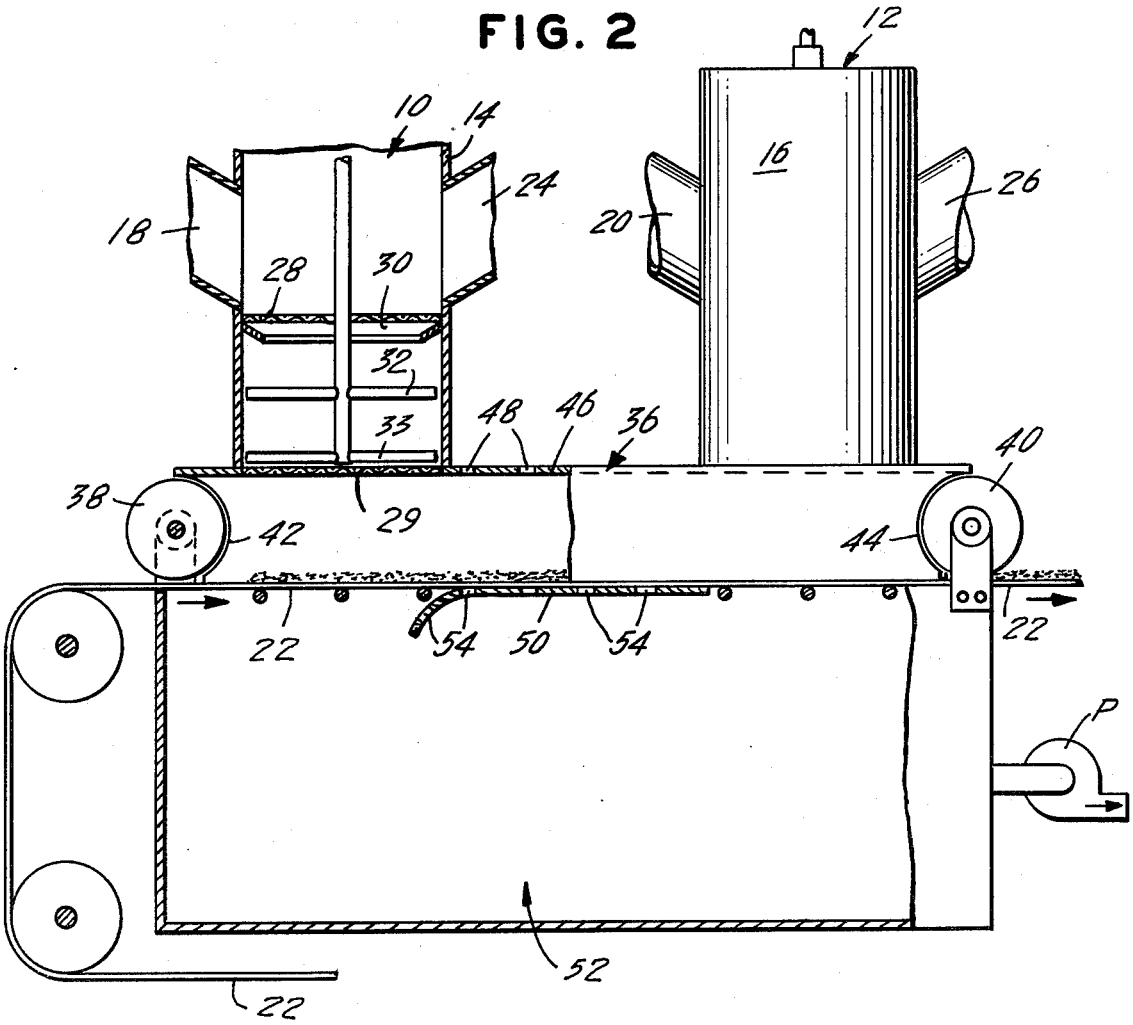
FIG. 2 is a side view, partly in section, of the apparatus of FIG. 1

Referring to the figures, two fiber distributors 10 and 12 have walls 14 and 16 which are in the shape of an oval. Inlet conduits 18 and 20 receive fibers which are to be impelled onto a foraminous wire belt 22. The fibers may be received, for example, from a hopper or a hammer mill. Additional conduits 24, 26 are exit conduits through which fibers too large to pass through the foraminous screen 28 are withdrawn and returned, for example, to the hammer mill.

A coarse foraminous screen 28 covers the entire wall-to-wall area of the distributors 10 and 12 in the region immediately above the impellers 32, 34 to screen out fiber particles of excess size which are then drawn out through conduits 24 and 26. The fibers delivered through screen 28 are centered in the distributors 10 and 12 by ledges, such as ledge 30, to deliver the fibrous material to the impellers 32, 33, 34 and a fourth impeller (not shown) below the impeller 34.

The source of supply for the fibers, the reservoir or hammer mill connected to the exit conduits, the source of power for rotating the impellers and the source of power for moving the foraminous wire belt 22 are not shown.

The impellers, such as impellers 32, 33, 34 may be bars or blades, and they may or may not have torsion in the blade like an aircraft propeller. A foraminous screen 29 extends from wall-to-wall across the bottom opening of the distributors 10, 12 to allow only fibers below a certain size to be deposited onto the moving wire belt 22.

A tunnel 36 encloses the bottoms of the distributors 10 and 12 and the wire belt 22 under the distributors 10, 12 and between the distributors 10, 12. The tunnel 36 is substantially closed at its ends by a pair of rollers 38, 40 disposed for rolling engagement with belt 22 and fibers thereon, and having a small gap 42, 44 which may be adjusted to allow only a small amount of air to flow directly into the tunnel from the ends thereof. The top wall 46 of tunnel 36 between the distributors 10 and 12 has a plurality of perforated openings 48 which allow air to flow from the outside of the tunnel 36 directly into the tunnel 36. A baffle plate 50 is positioned below the openings 48 and below the belt 22 within the chamber 52 which is under a partial vacuum. The baffle plate 50 has a plurality of openings 54 therein to accommodate air flow directly downwardly from the openings 48 onto the fibers and belt, the fibers being subjected to the partial vacuum through perforations in the baffle plate. The vacuum in chamber 52 holds the fibers on the foraminous wire belt 22 as it is caused to travel in the direction of spacing of the distributor bottom openings, for the full length of the tunnel 36. The means for producing a vacuum in the chamber 52 is shown diagramatically at P;

Thus, with the apparatus of this invention, the deposited fibers on the wire belt 22 are held on the belt and do not fluff or rise up in the region between the two fiber distributors 10 and 12.

Although the invention has been described in detail above, it is not intended that the invention should be limited by that description be only in accordance with the combination of that description and the appended claims.

I claim:

1. An apparatus for depositing a uniform web of dry fibers on a foraminous wire belt, the combination comprising: at least a pair of fiber distributors having bottom openings disposed in spaced relationship; foraminous screens extending over said openings through which fibers may pass from said distributors; means defining a tunnel extending beneath said openings, in air flow communication therewith, and including a horizontal upper wall portion extending between said distributors; a movable foraminous wire belt disposed within said tunnel for travel therethrough in the direction of spacing of said openings; means for introducing dry fibers to said distributors for discharge through said screens onto said foraminous wire belt as it is moved therepast; means for sealing the ends of said tunnel aginst air leakage while accommodating movement of said belt therethrough; means for producing a partial vacuum below said belt; and means defining perforations in said upper horizontal wall portion of said tunnel for accommodating air flow from outside said tunnel onto the underlying portion of said belt and fibers thereon.

2. The apparatus of claim 1, wherein said means for sealing the ends of said tunnel comprise a pair of rollers each closely spaced as respects its end of said tunnel and disposed for rolling engagement with said belt and fibers thereon.

3. The apparatus of claim 1 or 2, including a perforated baffle plate disposed below said foraminous wire belt in the region thereof between said distributors, the fibers in said region being subjected to the recited partial vacuum through perforations in said baffle plate.

* * * * *